US005171096A

United States Patent [19]

Perrotti

[11] Patent Number: 5,171,096

[45] Date of Patent: Dec. 15, 1992

[54] HOLDER FOR LIPSTICK WITH MOVABLE COVERS

[76] Inventor: Dominic Perrotti, 209 Westwood Rd., Southington, Conn. 06489

[21] Appl. No.: 888,859

[22] Filed: May 27, 1992

[51] Int. Cl.[5] ..... A45D 40/06; A45D 40/22

[52] U.S. Cl. ..... 401/59; 401/60

[58] Field of Search ..... 401/59, 60

[56] References Cited

U.S. PATENT DOCUMENTS

| | | | |
|---|---|---|---|
| 1,979,828 | 11/1934 | Fullmer . | |
| 2,002,716 | 5/1935 | Richter . | |
| 2,091,312 | 8/1937 | Fullmer . | |
| 2,111,767 | 3/1938 | Gimonet | 401/59 |
| 2,404,815 | 7/1946 | Satz et al. . | |
| 2,443,361 | 6/1948 | Satz et al. . | |
| 2,463,086 | 3/1949 | Chabbert . | |
| 2,552,697 | 5/1951 | Tursky . | |
| 2,610,732 | 9/1952 | Calhoun . | |
| 3,709,618 | 1/1973 | Gruska . | |

FOREIGN PATENT DOCUMENTS

| | | | |
|---|---|---|---|
| 770006 | 9/1934 | France | 401/59 |
| 788972 | 10/1935 | France | 401/59 |
| 940758 | 12/1948 | France | 401/59 |

*Primary Examiner*—Steven A. Bratlie

[57] ABSTRACT

A cosmetic stick holder has a housing with an opening at its upper end and a sidewall with access apertures therein, and a body member seated in the housing with a generally circular sidewall having access apertures therein. A generally cylindrical guide member is seated in the body member and has a pair of diametrically spaced, axially extending slots, and a tubular thimble of generally annular cross section is seated between the body and guide members in alignment with the apertures of the housing and body member so as to be manipulatable therethrough. The thimble has a helically extending channel on its inner surface and is rotatable relative to the body and guide members. A carrier cup has guide pins extending radially outwardly from its sidewall through the axially extending slots of the guide member and slidably seating in the helical channel of the thimble, so that its rotation produces movement of the carrier cup axially. A rider is movable axially within the lower end of the body member and abuts the lower end of the carrier cup. A pair of links have elongated connector elements extending axially between the housing and body member, and lower leg elements extending in opposed relationship which are pivotally connected intermediate their length to the body member and at their other end to the rider. A pair of cover members have one end pivotally supported on the upper ends of the links, and extend across and close the top opening of the housing when in a horizontal disposition. Axial movement of the rider causes the lower leg elements of the links to pivot in a toggle action and move the connector elements upwardly and downwardly to pivot the cover members into open and closed position.

17 Claims, 6 Drawing Sheets 11
12
18
22
24
44
66
68
86
90
93
94
96
98
100
102
104
106
114

HOLDER FOR LIPSTICK WITH MOVABLE COVERS

BACKGROUND OF THE INVENTION

The present invention relates to holders for lipstick and other cosmetic sticks and, more particularly, to a unitary lipstick holder in which the cover may be readily opened by one hand.

Holders for lipsticks and other cosmetic sticks are widely employed, and they may be found in various configurations, fabricated from various materials, and employ a unitary assembly or a separate caps or covers. Unitary assemblies which minimize the likelihood of losing damaging a removable cap are desirable, and various constructions have been proposed including those illustrated in Richter U.S. Pat. No. 2,002,716, Fullmer et al U.S. Pat. No. 2,091,312, Satz et al U.S. Pat. No. 2,404,815, Chabbert U.S. Pat. No. 2,463,086, Tursky U.S. Pat. No. 2,552,697, Calhoun U.S. Pat. No. 2,610,732 and Gruska U.S. Pat. No. 3,709,618.

Some unitary holders require two hands for manipulation, others require relatively complex structures and are difficult to assemble or to fabricate; and others are relatively unattractive in their final design or require substantial component modification of components if one desired to modify the external configuration or dimensions. As a result, there has remained a need to provide simple attractive economical cosmetic stick holders which can be manipulated by one hand to expose the cosmetic stick contained therewithin.

It is an object of the present invention to provide a novel holder for cosmetic sticks which may be readily fabricated and which is easily manipulated by one hand to expose the lipstick or the like.

It is also an object to provide such a cosmetic stick holder which may be readily modified in external configuration and appearance while maintaining the ease of manipulation and the same operational components.

Another object is to provide such a cosmetic stick holder which may be fabricated relatively economically from a series of easily fabricated parts and which may be quickly and readily assembled.

SUMMARY OF THE INVENTION

It has now been found that the foregoing and related objects may be readily attained in a cosmetic stick holder comprising a housing providing an opening at its upper end and a sidewall having at least one access aperture therein for manipulation of an element contained therewithin. Seated in the housing is a body member with a generally annular cross section and providing an opening at its upper end. The body member has a base and a generally circular sidewall extending upwardly from the base with at least one aperture therein aligned with the aperture of the housing sidewall.

A generally cylindrical guide member is disposed in the body member and has a pair of diametrically spaced, axially extending slots therein. Disposed between the body and guide members is a tubular thimble of generally annular cross section, and it is rotatable relative thereto. The thimble has a helically extending channel on its inner surface and is supported on one of the guide and body members in alignment with the apertures of the housing and body member so as to be manipulatable therethrough.

Disposed within the guide member is a carrier cup of generally circular cross section, and it has a base, a sidewall, and guide pins extending radially outwardly from its sidewall through the axially extending slots of the guide member. A guide pin is also slidably seated in the helical channel of the thimble so that rotation of the thimble produces movement of the carrier cup axially of the guide member. A rider is disposed within the body member adjacent its lower end, and it is movable axially therewithin. Its upper surface abuts the lower surface of the carrier cup which is vertically supported thereon.

A pair of links are disposed in the housing outwardly of the body member, and each has an elongated connector element extending axially between the housing and body member. Each of the links also has a lower leg element having one end pivotally connected to the lower end of its connector element, and the lower leg elements extend in opposed relationship therefrom. Each of the lower leg elements is also pivotally connected intermediate its length to the body member and has its other end pivotally connected to the rider. A pair of cover members have one end pivotally supported on the upper end of the links, and they are dimensioned and configured to extend across and together close the top opening of the housing when in a horizontal disposition. Axial movement of the rider downwardly in the body member causes the lower leg elements of the links to pivot upwardly and move the connector element upwardly to pivot the cover members downwardly to close the opening of the housing. Axial movement of the rider upwardly in the body member causes the lower leg elements to pivot downwardly to move the connector elements downwardly and pivot the cover members upwardly and draw them downwardly into the housing to open the top opening of the housing.

Preferably, the housing includes a cap on the upper end of its sidewall and it provides a rim extending about the opening in the top of the housing. Desirably, the cap provides horizontally extending shoulders below the rim upon which the cover members seat in the horizontal closed position thereof.

In the preferred embodiment, there is included spring means biasing the rider and thereby the carrier cup upwardly, and this spring means acts upon the rider and thereby the carrier cup. The pivotal connections of the lower leg elements of the links to the body member and rider are oriented to provide a toggle action for the links. Desirably, the body member includes a cylindrical pedestal on its base wall providing an upwardly opening cavity, and the spring means is a helical compression spring having its lower end seated in the pedestal cavity. The rider has a downwardly opening cavity seating the upper end of the spring.

In the preferred embodiment, the rider has rectilinear side surfaces with horizontally extending channels and the pivotal connection of the lower leg elements thereto is provided by pins seated in these channels. The links also have upper leg elements pivotally connected to the upper ends of the connector elements and upon which the cover members are mounted. There is also included means biasing the cover members to pivot downwardly about the pivotal connection to the connector elements.

DETAILED DESCRIPTION OF THE PREFERRED EMBODIMENT

Figure 1:
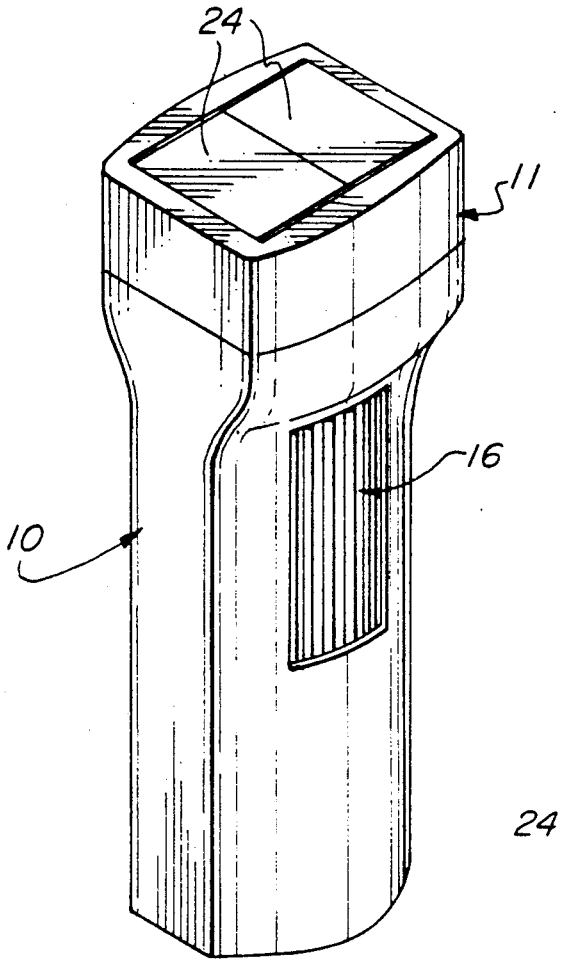
FIG. 1 is a perspective view of a lipstick holder embodying the present invention.
Figure 2:
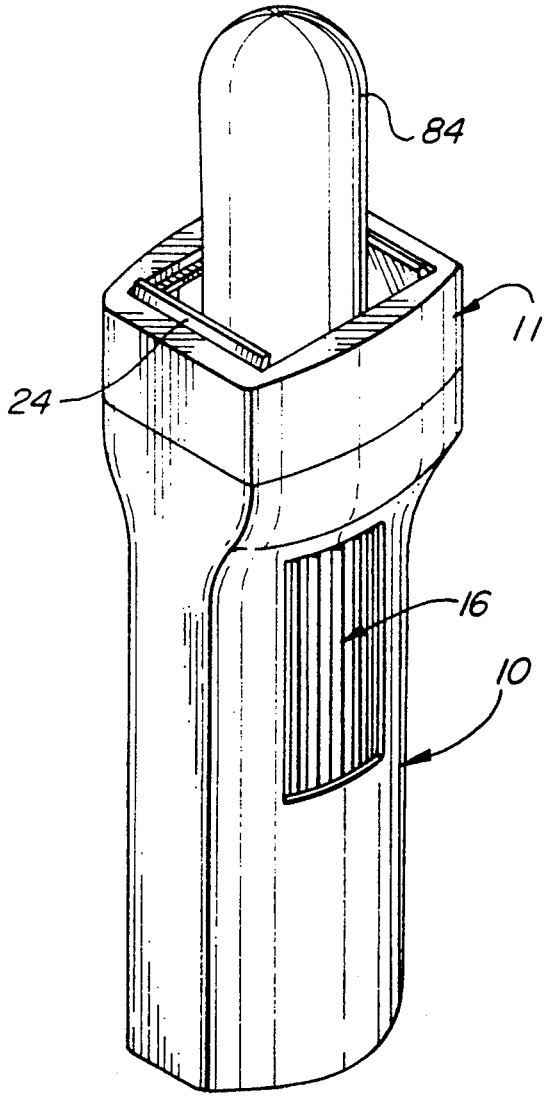
FIG. 2 is a similar perspective view but with the holder manipulated to open the covers and project the lipstick contained therein.
Figure 3:
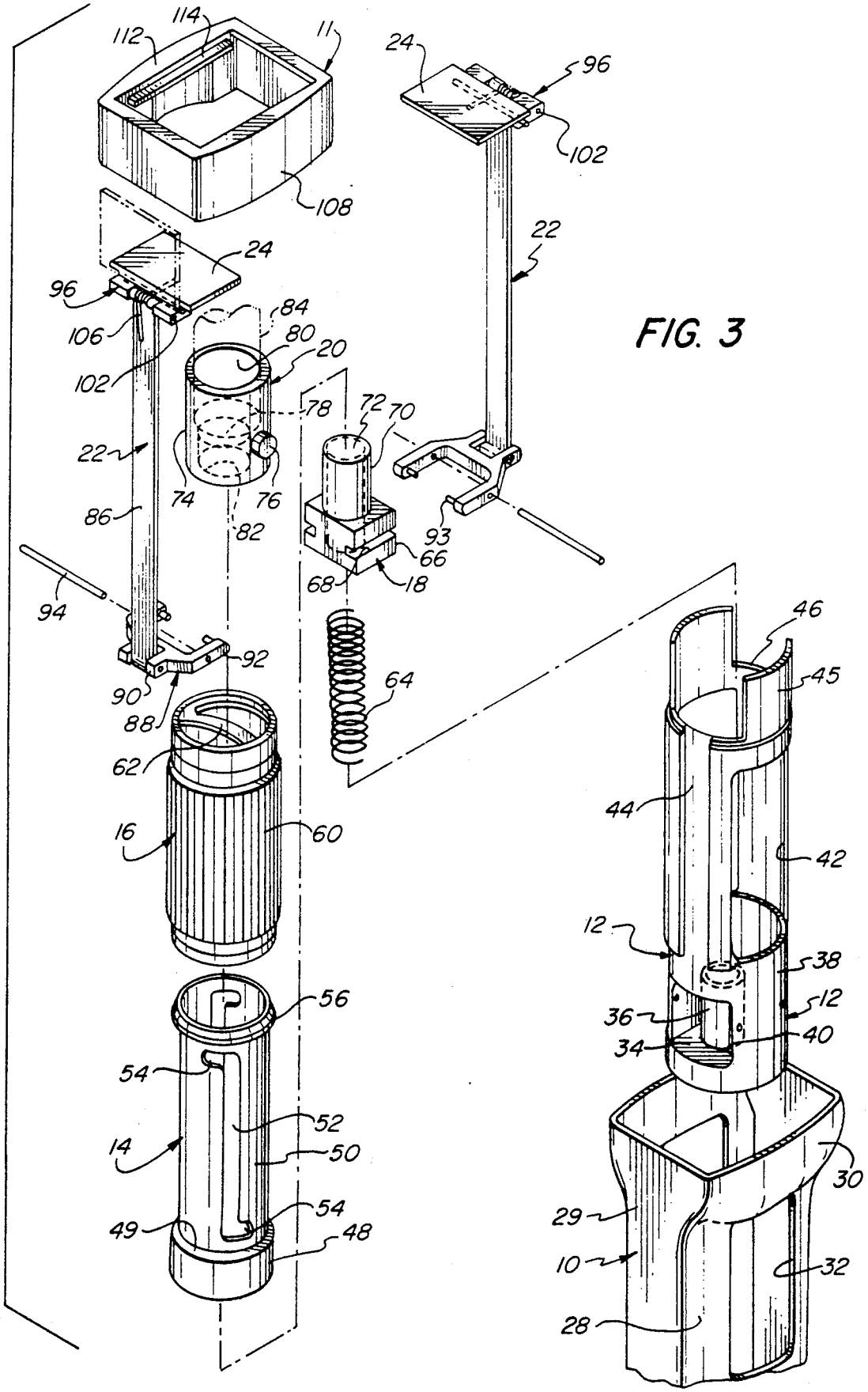
FIG. 3 is a partially exploded perspective view of the lipstick holder.

Turning first to FIGS. 1 and 2, therein illustrated is a lipstick holder embodying the present invention and generally comprised of a housing 10 with a cap 11 about its open upper end, and a pair of pivotally mounted cover members generally designated by the numeral 24 which close the open end of the housing. By finger rotation of the spindle 16, the lipstick holder will open or close the cover members 24 and project or withdraw the lipstick 84.

Turning next to FIGS. 3–6, it can be seen that the housing 10 has a base or bottom wall 26, opposed side walls 28 which are convexly arcuate, and end walls 29 which are essentially rectilinear. The upper ends of the side walls 28 and end walls 29 flare outwardly to provide a flared top portion 30 providing a greater cross sectional area in the upper portion of the housing 10. The sidewalls 28 are provided with axially elongated apertures 32 through which the thimble 16 may be manipulated.

Seated within the housing 10 is a body member generally designated by the numeral 12 which has a base 34 with a centrally disposed tubular spring guide pedestal 36. It also has a side wall 38 of generally circular cross section, with a pair of diametrically spaced apertures 40 adjacent the base 34 and a pair of axially elongated apertures 42 spaced upwardly therefrom. In addition, the sidewall 38 is formed with axially extending channels 44 between the apertures 42, and the upper end portion 45 is provided with diametrically spaced notches 46.

Disposed within the body member 12 is a guide member generally designated by the numeral 14 and which is of generally circular cross section. It has a base portion 48 and a sidewall 50 with a pair of diametrically disposed, axially extending slots 52 having transversely extending portions 54 at each end thereof. The sidewall 50 is of smaller diameter than the base portion 48 to provide a circumferential shoulder 49 therebetween, and extending about the upper portion of the sidewall 50 is a bead or rib 56.

Figure 4:
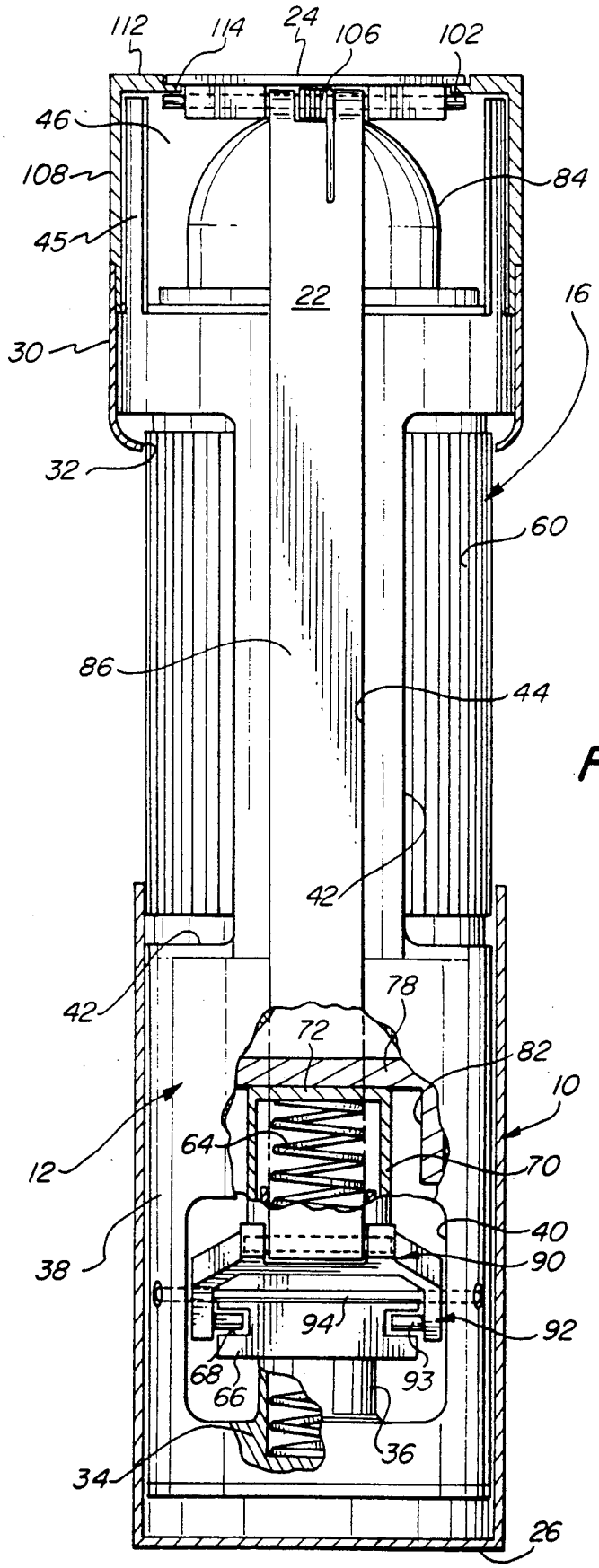
FIG. 4 is a side elevational view in partial section of the lipstick holder with the covers closed.
Figure 5:
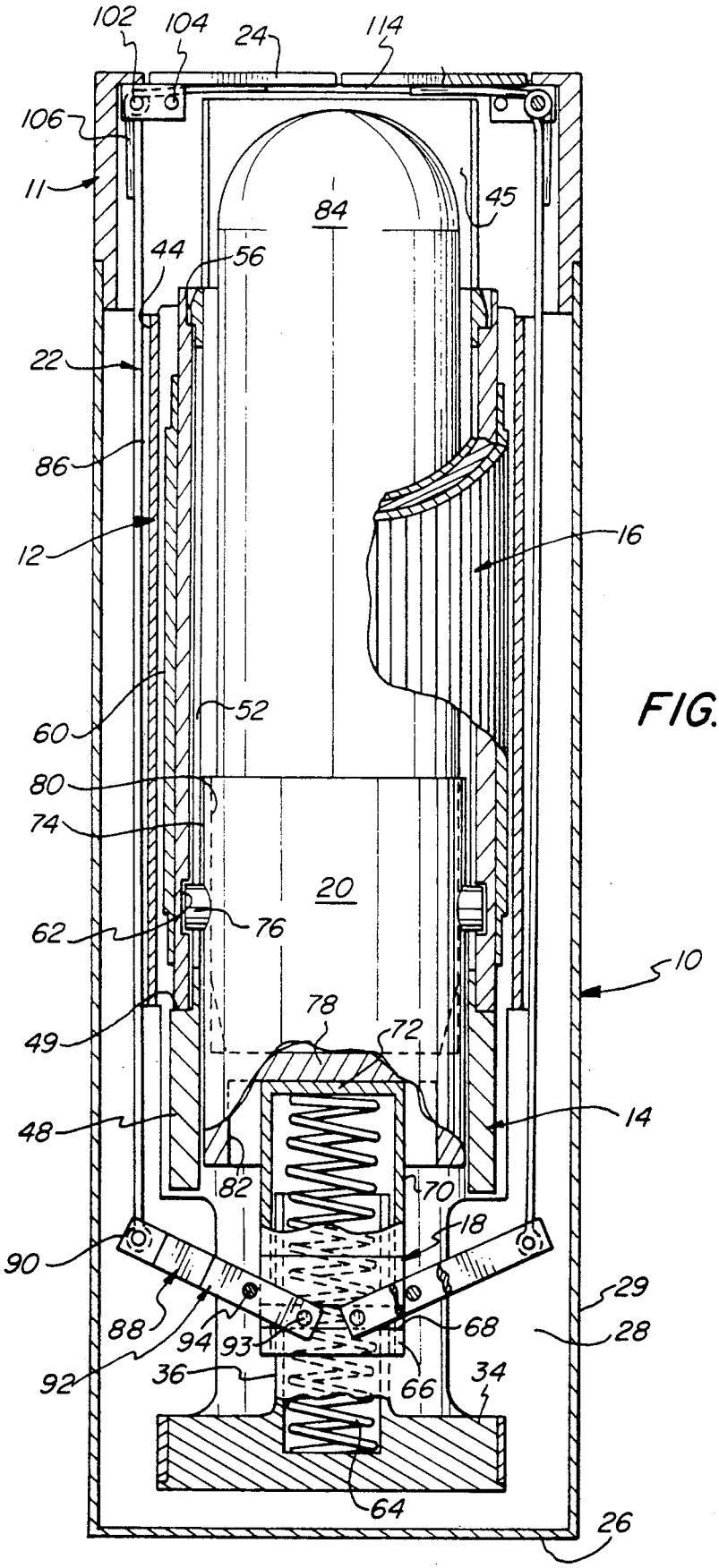
FIG. 5 is a similar side elevational view in partial section, with the holder rotated 90° from the position seen in FIG. 4.
Figure 6:
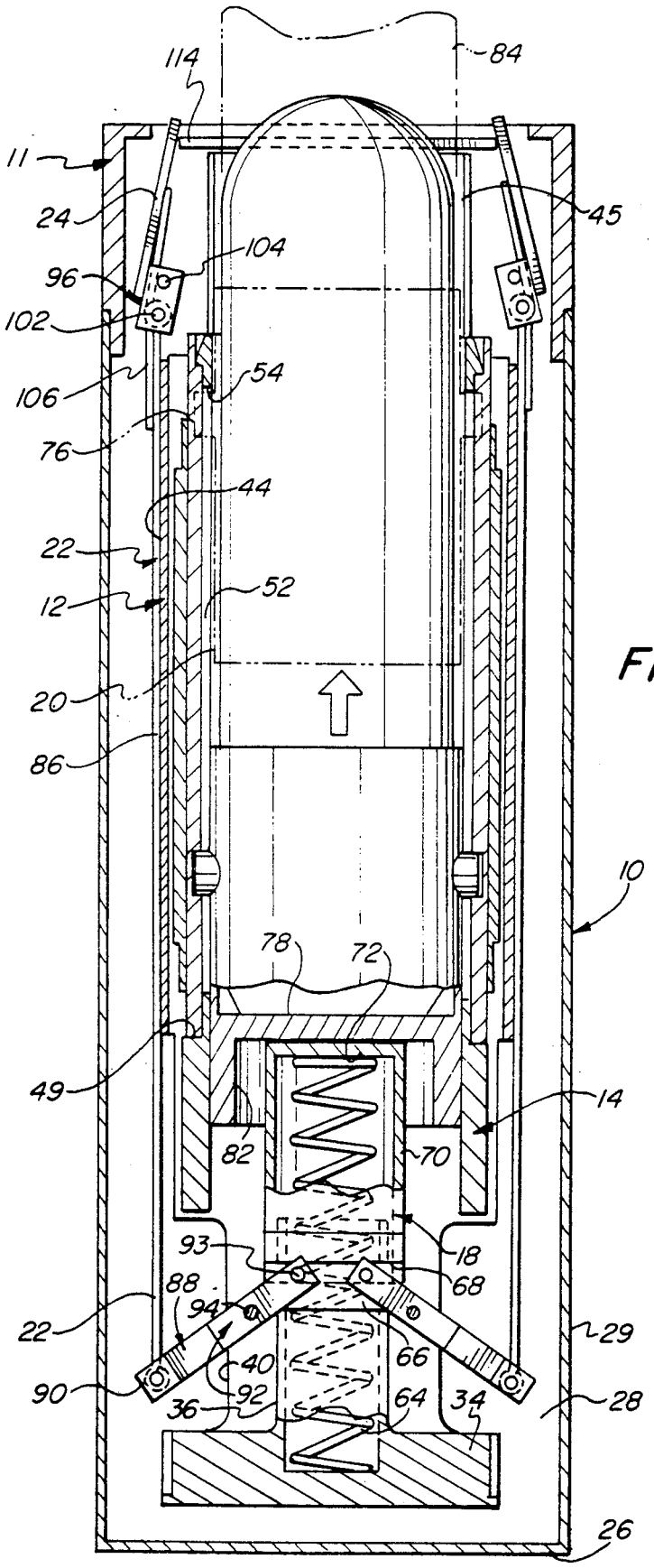
FIG. 6 is a view similar to FIG. 5, but with the operating elements manipulated into the cover opening position showing the elevated position of the lipstick in phantom line.

Rotatably seated on the guide member 14 is the thimble generally designated by the numeral 16, and it has a sidewall 56 of circular cross section with a ribbed central portion 60 and a helical track 62 on its inner surface. As seen in FIGS. 4–6, its lower end is slidably seated on the shoulder 49 of the guide member 14.

Seated within the upwardly opening cavity provided in the spring guide pedestal 36 of the body member 12 is a helically coiled compression spring 64 which biases upwardly the rider member generally designated by the numeral 18. As can be seen, the rider member 18 has a generally rectangular base 66 with transversely extending channels 68 along two opposed rectilinear side faces thereof, downwardly opening or recess 69. On the upper surface of the base 66 is a generally cylindrical pedestal 70 which has a top wall 72. A cylindrical recess or cavity 69 extends inwardly from the lower surface of the base 66 into the pedestal 70, and the upper end portion of the spring 64 is seated therein.

Seated in turn upon the top wall 72 of the pedestal 70 is the carrier cup 20 which is of circular cross section and which has a upper cavity 80 and a lower cavity 82 separated by the transverse wall 78. The sidewall 74 of the carrier cup 20 has a pair of diametrically spaced radially extending guide pins 76 which extend through the axially extending slots 52 in the guide member 14 and into the helical track 62 on the inner wall of the thimble 16. As can be seen, the lower cavity 82 receives the upper portion of the pedestal 70 of the rider member 48, and the lipstick 84 is seated in the upper cavity 80 on the transverse wall 78.

The cap 11 has rectilinear end walls 110 and arcuate side walls 108, and it has an inwardly extending lip 112 extending about the upper end of the walls 110, 112 which is configured to provide a rectangular opening for the covers 24 to close. Spaced below the lip 112 on the side walls 108 are horizontally extending shoulders 114 which seat the covers 24 in their horizontally disposed, closing position.

The covers 24 are pivotally supported on links generally designated by the numeral 22. Each link has an elongated vertically extending connector element 86 which is disposed within a channel 44 of the body member 12, a lower leg element generally designated by the numeral 88, and an upper leg element generally designated by the numeral 96. The lower leg element 88 has a bifurcated mounting portion 90 which receives the lower end of the elongated connector element 86, and a pivot pin provides a pivotal connection thereto. It also has a bifurcated toggle portion 92 and is provided with a pair of opposed pins 93 adjacent its end which slidably seat in the channels 68 in the rider member 18. An elongated pivot pin 94 extends through the toggle portion 92 intermediate its length, and the pivot pin 94 has its ends journaled in the body member 12 as best seen in FIG. 4. The pivotal motion of the lower leg element 88 is about the pivot pin 94 to provide a toggle action as will be described more fully hereinafter.

Each upper leg element 96 has a pair of legs 98 on which the cover 24 is secured, and they receive the upper end of the elongated connector element 86 therebetween, with the pivot pin 102 providing the pivotal connection thereto. A spring pin 104 extends between the legs 98 at a point spaced below the cover 24, and a leaf spring 106 is mounted upon the pivot pin 102 with one of its legs extending downwardly along the elongated connector element 86. The other leg of the spring 106 extends along the lower surface of the cover 24 and is trapped between the cover 24 and the spring pin 104, thus providing a biasing action tending to pivot the cover member 24 downwardly about the pivot pin 102.

Figures 7, 8, 9:
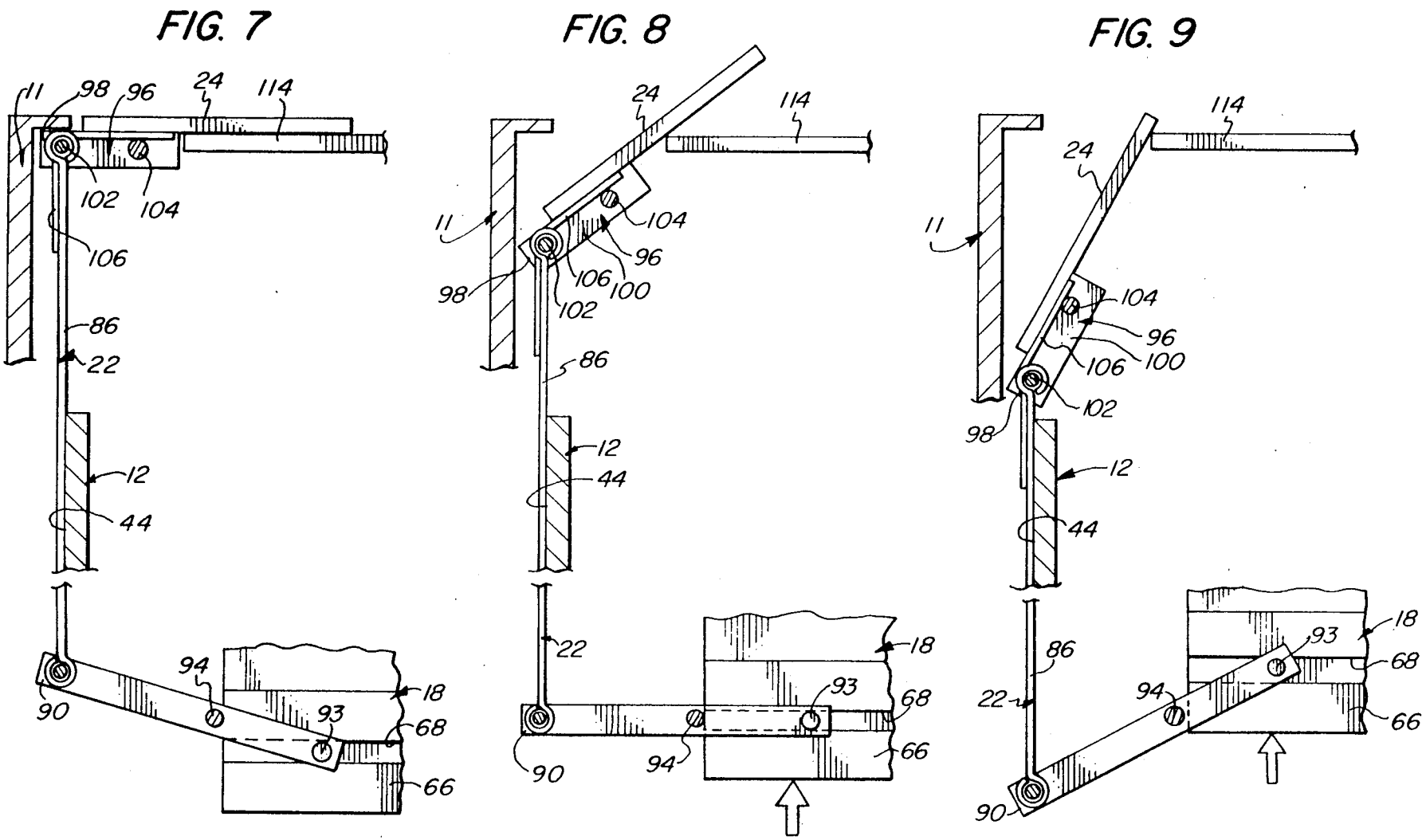
FIGS. 7, 8 and 9 are fragmentary partially schematic views showing the operation of the linkage to effect opening and closing motion of the covers.

As can be seen in FIG. 7, the shoulders 114 on the cap 11 limit the downward pivotal movement of the covers when the links are in their upper position and hold the covers 24 in the horizontal closed position.

As will be appreciated, the thimble 16 is exposed through the apertures 32 in the housing 10 so that the holder may be gripped by the user whose thumb and finger are in contact with the thimble 10 through the opposed apertures 32. The thimble 16 may then be rotated readily by the thumb and finger to open the covers 24 and elevate the cosmetic stick 84 to a projecting position in which it may be applied to the user's lips or any other surface. The covers 24 are firmly assembled to the housing 10 and substantially fully retract into the housing 10 in the open position. Moreover, movement of the covers 24 is not effected by the motion of the lipstick 84, and the covers 24 have no effect in lowering the cosmetic stick 84.

When the thimble 16 is initially rotated to open the holder, the carrier cup 20 moves upwardly and the rider member 18 is biased upwardly by the spring 64 after a relatively short movement of the carrier cup 20 and rider member 18, the lower leg elements 88 are toggled rapidly by the over center motion of the rider member 18 to move the elongated connector elements 86 downwardly.

As can be seen in FIGS. 7–9, movement of the connector elements 86 downwardly produces a pivoting of the covers 24. Thus, this toggle action provided by the lower leg elements 88 of the links 22 effects rapid opening of the covers 24 upon initial rotation of the thimble 16. Similarly, it effects rapid closing thereof after the cosmetic stick 84 has been withdrawn into the housing 10 and the downward movement of the carrier cup 20 pushes the rider member 18 past the center point of the toggle.

As will be readily appreciated, the various components can be easily fabricated from sheet metal and from synthetic resins. Depending upon the particular part and material selected, extrusion, stamping, casting and molding fabricating procedures may be employed, alone and in combination to fabricate the several parts.

After the parts have been fabricated, the internal operating components and covers are preassembled, and this assembly is inserted into the housing, after which the cap may be assembled onto the body of the housing. The cap may be secured to the body by staking, soldering, adhesives or any other suitable means. As will be readily appreciated, all of the operating components are disposed and supported within the housing.

The housing can be modified into a myriad of external configurations and employ a variety of surface finishes without changing the interior operating components. The only requirement for use of the same operating component assembly is that the case be dimensioned to provide a relatively snug fit for the operating component assembly or that suitable spacer elements be provided to secure the operating component assembly snugly within the case.

Although a single access aperture may be employed, manipulation of the thimble on both sides of the case is much easier and desirable symmetry is provided by a pair of apertures.

Thus, it can be seen from the foregoing detailed specification and attached drawings that the cosmetic stick holder may be readily fabricated and is easily manipulated to expose the lipstick. The holder may be readily modified in external configuration and appearance while maintaining the ease of manipulation and construction. The components of the holder may be fabricated relatively economically from a series of easily fabricated parts which may be quickly and readily assembled.

Having thus described the invention, what is claimed is:

1. A cosmetic stick holder comprising:

(a) a housing having an opening at its upper end and a sidewall with at least one access aperture therein for manipulation of an element contained therewithin;

(b) a body member seated in said housing and having a generally annular cross section, said body member providing an opening at its upper end and having:

(i) a base, and (ii) a generally circular sidewall extending upwardly from said base and having at least one aperture therein aligned with said at least one aperture of said housing sidewall;

(c) a generally cylindrical guide member in said body member and having a pair of diametrically spaced, axially extending slots therein;

(d) a tubular thimble of generally annular cross section within said body member and about said guide member, said thimble being rotatable relative to said body and guide members, said thimble having a helically extending channel on its inner surface, said thimble being supported on one of said members in alignment with said apertures of said housing and body member to be manipulatable therethrough;

(e) a carrier cup of generally circular cross section and having a base, a sidewall, and guide pins extending radially outwardly from said sidewall through said axially extending slots of said guide member and slidably seated in said helical channel of said thimble, whereby rotation of said thimble produces movement of said carrier cup axially of said guide member;

(f) a rider within said body member adjacent its lower end and movable axially therewithin, the upper surface of said rider abutting the lower surface of said carrier cup which is vertically supported thereon;

(g) a pair of links disposed in the housing outwardly of the body member and each having an elongated connector element extending axially between said housing and body member, each of said links also having a lower leg element having one end pivotally connected to the lower end of its connector element, said lower leg elements extending in opposed relationship from said lower ends, each of said lower leg elements also being pivotally connected intermediate its length to said body member and having its other end pivotally connected to said rider; and (h) a pair of cover members having one end pivotally supported on the upper end of said links, said cover members being dimensioned and configured to extend across and close said top opening of said housing when in a horizontal disposition, axial movement of said rider downwardly in said body member causing said lower leg elements of said links to pivot upwardly and move said connector element upwardly to pivot said cover members downwardly to close said opening of said housing, and axial movement of said rider upwardly in said body member causing said lower leg elements to pivot downwardly to move said connector elements downwardly and pivot said cover members upwardly and draw them downwardly into the housing to open said top opening of said housing.

2. The cosmetic stick holder in accordance with claim 1 wherein said housing includes a cap on the upper end of said sidewall providing a rim extending about said opening in the top of said housing.

3. The cosmetic stick holder in accordance with claim 2 wherein said cap provides horizontally extending shoulders below said rim upon which said cover members seat in the horizontal closed position thereof.

4. The cosmetic stick holder in accordance with claim 1 wherein there is included spring means biasing said rider and thereby said carrier cup upwardly.

5. The cosmetic stick holder in accordance with claim 4 wherein said spring means acts upon said rider and thereby said carrier cup.

6. The cosmetic stick holder in accordance with claim 5 wherein the pivotal connections of said lower leg elements to said body member and said rider are oriented to provide a toggle action.

7. The cosmetic stick holder in accordance with claim 5 wherein said body member includes a cylindrical pedestal on said base wall providing an upwardly opening cavity and wherein said spring means is a helical compression spring having its lower end seated in said pedestal cavity.

8. The cosmetic stick holder in accordance with claim 7 wherein said rider has a downwardly opening cavity seating the upper end of said spring.

9. The cosmetic stick holder in accordance with claim 1 wherein said rider has rectilinear side surfaces with horizontally extending channels therein, and said pivotal connection of said lower leg elements of said links thereto is provided by pins seated in said channels.

10. The cosmetic stick holder in accordance with claim 1 wherein said links have upper leg elements pivotally connected to the upper ends of said connector elements and upon which said cover members are mounted.

11. The cosmetic stick holder in accordance with claim 10 wherein there are included spring elements biasing said cover members to pivot downwardly about the pivotal connection to said connector elements.

12. A cosmetic stick holder comprising:

(a) a housing having an opening at its upper end and a sidewall with at least one access aperture therein for manipulation of an element contained therewithin, said housing also having a cap on the upper end of said sidewall providing a rim extending about said opening in the top of said housing and horizontally extending shoulders below said rim upon which cover members seat in the horizontal closed position thereof;

(b) a body member seated in said housing and having a generally annular cross section, said body member providing an opening at its upper end and having:

(i) a base, and (ii) a generally circular sidewall extending upwardly from said base and having at least one aperture therein aligned with said at least one aperture of said housing sidewall;

(c) a generally cylindrical guide member in said body member and having a pair of diametrically spaced, axially extending slots therein;

(d) a tubular thimble of generally annular cross section within said body member and about said guide member, said thimble being rotatable relative to said body and guide members, said thimble having a helically extending channel on its inner surface, said thimble being supported on one of said members in alignment with said apertures of said housing and body member to be manipulatable therethrough;

(e) a carrier cup of generally circular cross section and having a base, a sidewall, and guide pins extending radially outwardly from said sidewall through said axially extending slots of said guide member and slidably seated in said helical channel of said thimble, whereby rotation of said thimble produces movement of said carrier cup axially of said guide member;

(f) a rider within said body member adjacent its lower end and movable axially therewithin, the upper surface of said rider abutting the lower surface of said carrier cup;

(g) spring means biasing said rider and thereby said carrier cup upwardly, said spring means acting upon said rider and thereby said carrier cup;

(h) a pair of links disposed in the housing outwardly of the body member and each having an elongated connector element extending axially between said housing and body member, each of said links also having a lower leg element having one end pivotally connected to the lower end of its connector element, said lower leg elements extending in opposed relationship from said lower ends, each of said lower leg elements also being pivotally connected intermediate its length to said body member and having its other end pivotally connected to said rider, the pivotal connections of said lower leg elements of said links to said body member and said rider being oriented to provide a toggle action; and (i) a pair of cover members having one end pivotally supported on the upper end of said links, said cover members being dimensioned and configured to extend across and close said top opening of said housing when in a horizontal disposition, axial movement of said rider downwardly in said body member causing said lower leg elements of said links to pivot upwardly and move said connector element upwardly to pivot said cover members downwardly to close said opening of said housing, and axial movement of said rider upwardly in said body member causing said lower leg elements to pivot downwardly to move said connector elements downwardly and pivot said cover members upwardly and draw them downwardly into the housing to open said top opening of said housing.

13. The cosmetic stick holder in accordance with claim 12 wherein said body member includes a cylindrical pedestal on said base wall providing an upwardly opening cavity and wherein said spring means is a helical compression spring having its lower end seated in said pedestal cavity.

14. The cosmetic stick holder in accordance with claim 13 wherein said rider has a downwardly opening cavity seating the upper end of said spring.

15. The cosmetic stick holder in accordance with claim 12 wherein said rider has rectilinear side surfaces with horizontally extending channels therein, and said pivotal connection of said lower leg elements thereto is provided by pins seated in said channels.

16. The cosmetic stick holder in accordance with claim 12 wherein said links have upper leg elements pivotally connected to the upper ends of said connector elements and upon which said cover members are mounted.

17. The cosmetic stick holder in accordance with claim 16 wherein there are included spring elements biasing said cover members to pivot downwardly about the pivotal connection to said connector elements.

* * * * *